US007874749B2

(12) United States Patent
Kimura

(10) Patent No.: US 7,874,749 B2
(45) Date of Patent: Jan. 25, 2011

(54) APPARATUS, METHOD, AND CONTROL PROGRAM FOR TURNING THE PAGES OF A PASSBOOK

(75) Inventor: Hiroshi Kimura, Chigasaki (JP)

(73) Assignee: International Business Machines Corporation, Armonk, NY (US)

( * ) Notice: Subject to any disclaimer, the term of this patent is extended or adjusted under 35 U.S.C. 154(b) by 543 days.

(21) Appl. No.: 11/944,687

(22) Filed: Nov. 26, 2007

(65) Prior Publication Data

US 2008/0157456 A1 Jul. 3, 2008

(30) Foreign Application Priority Data

Dec. 27, 2006 (JP) ..... 2006-352852

(51) Int. Cl.
*B41J 3/28* (2006.01)
*B42D 9/04* (2006.01)

(52) U.S. Cl. ..... 400/24; 400/76; 235/379

(58) Field of Classification Search ..... 400/24, 400/26, 27, 28
See application file for complete search history.

(56) References Cited

U.S. PATENT DOCUMENTS 5,507,481 A * 4/1996 Meyer et al. ..... 271/240
5,797,599 A * 8/1998 Meyer et al. ..... 271/272
6,398,431 B2 * 6/2002 Kimura et al. ..... 400/27

FOREIGN PATENT DOCUMENTS

JP 62148297 A 7/1987
JP 1139436 A 5/1989
JP 01-244894 9/1989
JP 03247495 A * 11/1991
JP 05-024381 2/1993
JP 05-305790 11/1993
JP 06099680 A * 4/1994
JP 2000-318349 11/2000
JP 2000351256 A * 12/2000
JP 2003182262 A * 7/2003
JP 2004-082364 3/2004

* cited by examiner

*Primary Examiner*—Daniel J Colilla
(74) *Attorney, Agent, or Firm*—Andrea Bauer; Hoffman Warnick LLC

(57) ABSTRACT

A page turning apparatus of a passbook printer, which detects a turning error or the like at the early stage of turning irrespective of the size and characteristics of passbooks and allows retry of turning in a short time. The apparatus includes: a passbook conveying path; a detecting device placed on the conveying path; storing means that stores a passbook holding position and a threshold value corresponding to a determined size; a page turning mechanism configured to buckle the paper of an turning target page and to turn the buckled paper at the passbook holding position; a buckling sensor that senses a buckling status; a conveying mechanism that can convey the passbook to a designated position on the conveying path; and control means configured to drive the conveying mechanism so that the passbook is conveyed to the passbook holding position, and drive the page turning mechanism to buckle the paper, wherein the control means, if the buckling status sensed by the buckling sensor indicates that the buckling extent does not reach over the threshold value within a predetermined time, determines that the buckling has failed and drives the conveying mechanism so that the passbook is conveyed from the passbook holding position to a revised position apart therefrom by a predetermined adjusting distance.

17 Claims, 10 Drawing Sheets

PRIOR ART

PRIOR ART (a)

APPARATUS, METHOD, AND CONTROL PROGRAM FOR TURNING THE PAGES OF A PASSBOOK

TECHNICAL FIELD

The present invention relates to a technique of turning pages in passbook printing available printers (passbook printers), and more specifically, it relates to an apparatus, method, and control program for executing optimum page turning in the event of a turning error or multiple turning.

BACKGROUND ART

Passbook printers which can print on notebooks such as passbooks have a built-in page turning apparatus which is a mechanism to automatically turn pages without involvement by the user. Specifically, when entries to a page in printing are finished and entries to the next page are necessary, the printers themselves execute automated page turning without ejecting passbooks.

To execute the automated passbook page turning, a turning mechanism has been used in which a turning roller is first landed on (brought into contact with) a turning target page, that is, the latter of the spread pages of the passbook, and is then rotated to shift the paper by friction, thereby raising the paper between the landed position and the folding axis of the passbook (or the central fold) (this is referred to as buckling). Then, when a sensor or the like senses that the buckling of the paper has reached a predetermined level, the turning roller is further rotated to bounce the paper onto the turning roller, thereby placing it onto the first half of the spread pages.

However, when various types passbooks of different sizes, particularly, different lengths from the folding axis to the opposed side of the spread pages (hereinafter, referred to as "passbook length") are handled by the same turning mechanism, the turning behavior must be changed from one passbook to another. In other words, for passbook printers for use in countries in which the passbook length has a unified standard, page turning apparatuses can be optimized to the passbook length. However, a significant number of countries use passbooks of different lengths. Conventional passbook printers used in such countries must be optimized to some of the passbook lengths. Therefore, turning of the pages of passbooks of significantly different sizes is prone to cause troubles such as double turning or page folding.

Referring to the accompanying drawings, the conventional technique will be described hereinbelow, wherein like reference numerals designate like or corresponding components throughout.

FIG. 1 shows an example of the mechanism of a page turning apparatus 100 for use in conventional passbook printers. Page turning rollers (also referred to as turning rollers) 102 are fixed to a roller shaft 104 and are retained by arms 106. At the time a passbook is conveyed from the left to the page turning apparatus 100, the arms 106 are held substantially horizontal with pins 110 fixed to an actuating shaft 108, and the turning rollers 102 are retracted upward from the path of the passbook. The passbook is conveyed to a predetermined "passbook holding position" through the path between a bed plate 112 and a guide plate 114. A feed roller 116 that conveys the passbook also serves to fix the passbook to the position during page turning operation by the turning rollers 102.

FIG. 2 shows the page turning apparatus 100 of FIG. 1, as viewed from the side. The procedure of conventional page turning will be described with reference to FIG. 1 and FIGS. 2(*a*) to 2(*e*).

A passbook 202 is conveyed to a "passbook holding position", that is, a position at which the almost center of the latter of the spread pages is directly under the turning rollers 102 (the position at which A=B holds in FIG. 2(*a*)) (see FIG. 2(*a*)). The actuating shaft 108 is rotated counterclockwise through an angle by the attraction of an external solenoid (not shown) to tilt the pins 110 at the corresponding angle, thereby removing the restriction of the arms 106, so that the turning rollers 102 are pushed against the surface of the latter of the spread pages by the force of springs 118 (see FIG. 2(*b*)). The turning rollers 102, which are slowly driven counterclockwise via a belt 120 by the power of an external motor, shift only the uppermost paper 212 of the latter page by friction to "buckle" it in an angular form. At that time, the guide plate 114 made of a lightweight material is raised with a shaft 204 as a pivot (fulcrum) by the swell of the paper 212. The curved surface 206 on the pivot is detected by a reflective sensor 208 (see FIG. 2(*c*)).

As the detection by the sensor 208 triggers the removal of the attraction of the external solenoid, the actuating shaft 108 returns to the initial position to retract the turning rollers 102 upward. The turning rollers 102 then rotate counterclockwise at high speed for a predetermined time to bounce the angled paper 212 in contact with the surface of the turning rollers 102 above the turning rollers 102 (see FIG. 2(*d*)). The paper 212, when bounced, becomes substantially flat between the turning rollers 102 and the guide plate 114 (see FIG. 2(*e*)). Thereafter, as the passbook is conveyed to the left in FIG. 2, the bounced paper 212 is rolled under the turning rollers 102 to be placed on the first half of the spread pages. Thus, the turning operation is completed, and the guide plate 114 returns to the initial horizontal position by gravity (see FIG. 2(*a*)).

To execute the above-described turning operation to different-length passbooks by the same mechanism, it is desirable that the paper to be buckled be swelled at the same angle, and that the "passbook holding position" be set so that the distance from the passbook folding axis 210 to the position to which the turning rollers 102 land is held constant (that is, B is fixed in FIG. 2(*a*)). However, for short passbooks, this setting reduces the distance from the lower end of the passbooks to the turning rollers 102 landing position. This causes the lower end of the object paper to pass through the contact point of the turning rollers 102 at the stage of generating the same angled shape, to swell also the next page by the turning rollers 102. As a result, two sheets of paper are bounced above the turning rollers 102 to cause the problem of double turning.

Therefore, passbooks have generally been conveyed with the "passbook holding position" fixed so that the distance from the lower end of the passbook to the turning rollers 102 landing position is fixed (that is, A is fixed in FIG. 2(*a*)) irrespective of the passbook length. However, with such a "passbook holding position", the distance from the turning rollers 102 landing position to the folding axis 210 is in turn decreased. This makes the swell of buckled paper distorted and sharp as compared with that of standard-length passbooks to cause unsmooth bouncing, thus increasing troubles such as folds. Such troubles occur more frequently in passbooks made of limp paper (or soft paper).

To address these problems, Japanese Unexamined Patent Application Publication No. 2000-318349 describes an apparatus for turning pages in such a manner as to automatically adjust the position of a passbook in the optimum passbook holding position corresponding to passbook length information obtained by a sensor.

However, under this method, a page turning error or double (or multiple) turning cannot be recognized until page identification information such as printed page numbers is read by an optical page reader (OPR) after completion of the page turning process. In other words, in the event of a page turning error, the apparatus cannot move to a passbook-holding position adjusting process until the turning roller makes one rotation, then the passbook is conveyed to a position at which the page identification information can be read, and the information is read. This is not desirable because it takes much time. In the event of double turning, without a reverse turning mechanism, the passbook must be ejected, and the user must correct the page of the ejected passbook and insert it again, resulting in troublesome time-consuming work. This method is not useful for preventing a turning error or the like which is often caused directly by paper quality (the hardness or coefficient of friction of paper) and the property of the spread pages because it adjusts the passbook holding position in the event of a turning error or the like only with passbook length information.

SUMMARY OF THE INVENTION

The present invention provides an apparatus, method, and control program for executing optimum page turning. More specifically, the present invention detects the occurrence of a page turning error or multiple turning in the early stage of turning operation irrespective of the size and characteristics of an inserted passbook and allow page turning to be retried in a short time without the involvement of the user. Another object of the invention is to provide a learning function to prevent a turning error and multiple turning irrespective of the size and characteristics of an inserted passbook.

A first aspect of the present invention is directed to an apparatus equipped in a passbook printing available printer, for turning one of the pages of a passbook that is unfolded on both sides of the folding axis, and a method and control program for the same. The apparatus includes: (1) a conveying path through which the passbook is conveyed, (2) a detecting device placed in a position of the conveying path, for detecting the size of the pages of the passbook, (3) storing means for storing a passbook holding position on the conveying path corresponding to the size, and a threshold value corresponding to the size, (4) a page turning mechanism placed in the vicinity of the passbook holding position and configured to buckle the paper of a turning target page of the passbook conveyed to the passbook holding position and to turn the buckled paper about the folding axis until the paper is overlapped on the previous page of the turning target page, (5) a buckling sensor placed in the vicinity of the page turning mechanism, for sensing a buckling status for the paper, (6) a conveying mechanism for conveying with a position control and a driving control the passbook to a designated position on the conveying path, and (7) control means configured to drive the conveying mechanism so that the passbook passes through the detecting device, to recognize the passbook holding position corresponding to the size and the threshold value corresponding to the size by referencing the storing means, drive the conveying mechanism so that the passbook is conveyed to the passbook holding position, and drive the page turning mechanism so that it starts buckling of the paper, wherein the control means, if the buckling status sensed by the buckling sensor indicates that the buckling extent does not reach over the threshold value within a predetermined time, determines that the buckling has failed and drives the conveying mechanism so that the passbook is conveyed from the passbook holding position to a first revised position apart therefrom by a first adjusting distance.

A second aspect of the present invention is directed to an apparatus equipped in a passbook printing available printer, for turning one of the pages of a passbook that is unfolded on both sides of the folding axis, and a method for the same. The apparatus includes: (1) a conveying path through which the passbook is conveyed, (2) a detecting device placed in a position of the conveying path, for detecting the size of the pages of the passbook and the identification of the passbook, (3) storing means for storing a passbook holding position on the conveying path corresponding to the size, a threshold value corresponding to the size, and an offset distance corresponding to the identification, (4) a page turning mechanism placed in the vicinity of the passbook holding position and configured to buckle the paper of a turning target page of the passbook conveyed to the passbook holding position and to turn the buckled paper about the folding axis until the paper is overlapped on the previous page of the turning target page, (5) a buckling sensor placed in the vicinity of the page turning mechanism, for sensing a buckling status for the paper, (6) a conveying mechanism for conveying with a position control and a driving control the passbook to a designated position on the conveying path, and (7) control means configured to drive the conveying mechanism so that the passbook passes through the detecting device, to recognize the passbook holding position corresponding to the size and the threshold value corresponding to the size by referencing the storing means, to recognize the offset distance corresponding to the detected identification by referencing the storing means, to drive the conveying mechanism so that the passbook is conveyed to an offset holding position apart from the passbook holding position by the offset distance, and to drive the page turning mechanism so that it starts buckling of the paper, wherein the control means, if the buckling status sensed by the buckling sensor indicates that the buckling extent does not reach over the threshold value within a predetermined time, determines that the buckling has failed and drives the conveying mechanism so that the passbook is conveyed from the passbook holding position to a first revised position apart therefrom by a first adjusting distance.

A third aspect of the present invention is directed to an apparatus equipped in a passbook printing available printer, for turning one of the pages of a passbook that is unfolded on both sides of the folding axis, and a method for the same. The apparatus includes: (1) a conveying path through which the passbook is conveyed, (2) a detecting device placed in a position of the conveying path, for detecting the size of the pages of the passbook and the identification of the passbook, (3) storing means for storing a passbook holding position on the conveying path corresponding to the size, a threshold value corresponding to the size, and an offset distance corresponding to the identification, (4) a page turning mechanism placed in the vicinity of the passbook holding position and configured to buckle the paper of a turning target page of the passbook conveyed to the passbook holding position and to turn the buckled paper about the folding axis until the paper is overlapped on the previous page of the turning target page, (5) a buckling sensor placed in the vicinity of the page turning mechanism, for sensing a buckling status for the paper, (6) a conveying mechanism for conveying with a position control and a driving control the passbook to a designated position on the conveying path, (7) a multiple sheet sensor placed so as to sense the paper turning about the folding axis and configured to determine whether multiple papers including the paper are being turned, and (8) control means configured to drive the conveying mechanism so that the passbook passes through the detecting device, to recognize the passbook holding position corresponding to the size and the threshold value corresponding to the size by referencing the storing means, to recognize the offset distance corresponding to the detected identification by referencing the storing means, to drive the conveying mechanism so that the passbook is conveyed to an offset holding position apart from the passbook holding position by the offset distance, and to drive the page turning mechanism so that it starts buckling of the paper, wherein the control means, if the buckling status sensed by the buckling sensor indicates that the buckling extent does not reach over the threshold value within a predetermined time, determines that the buckling has failed and drives the conveying mechanism so that the passbook is conveyed from the passbook holding position to a first revised position apart therefrom by a first adjusting distance, and wherein if the multiple sheet sensor detects that the multiple papers are being turned, the control means drives the conveying mechanism so that the multiple papers return to the position before the buckling and that the passbook is conveyed to a second revised position apart from the passbook holding position by a second adjusting distance.

BRIEF DESCRIPTION OF THE DRAWINGS

These and other aspects and features of the present invention will be more readily understood from the following detailed description of the various aspects of the invention taken in conjunction with the accompanying drawings.

Figure 1:
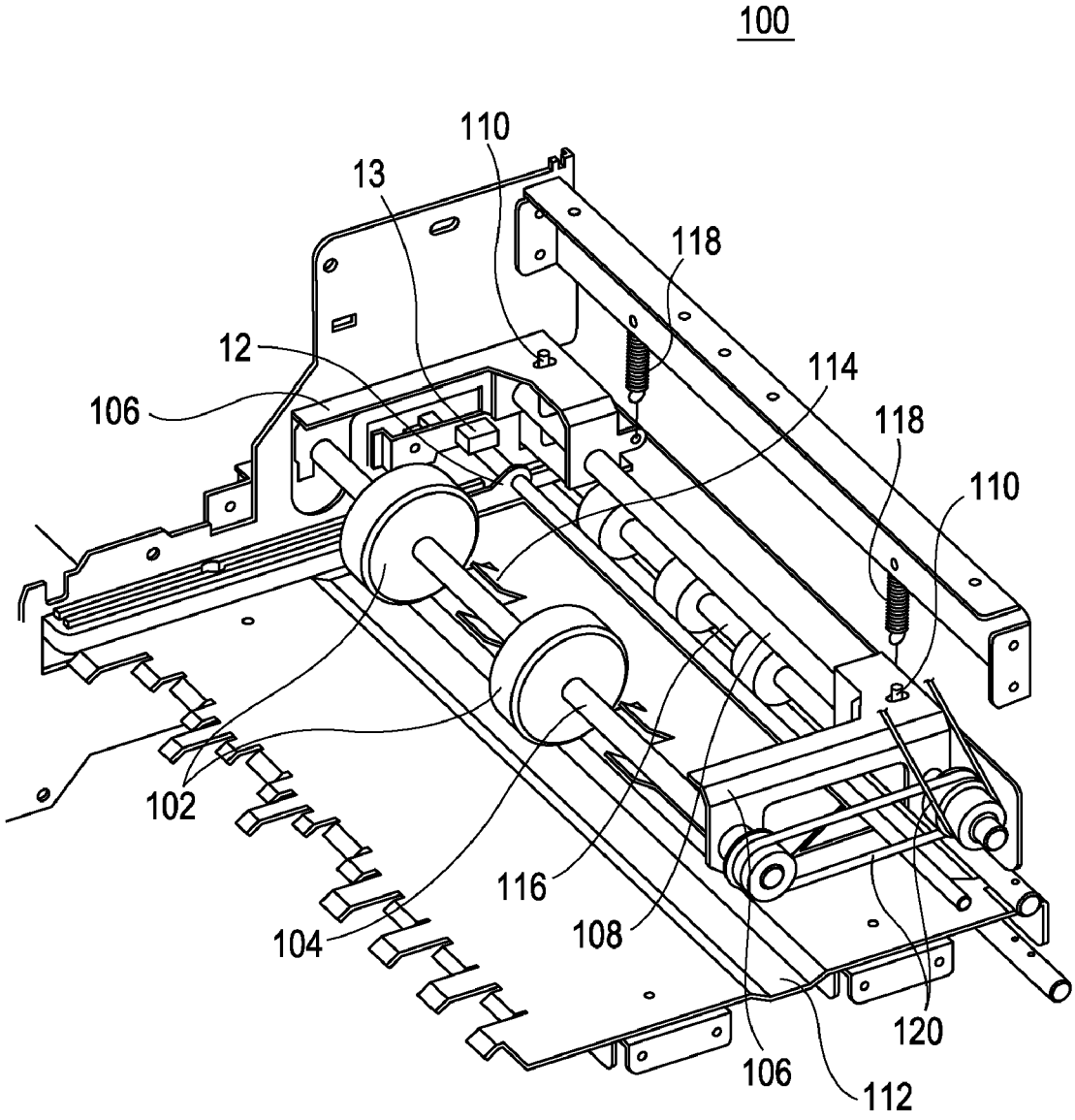
FIG. 1 shows an example of a mechanism of a page turning apparatus for use in conventional passbook printers.
Figure 2:
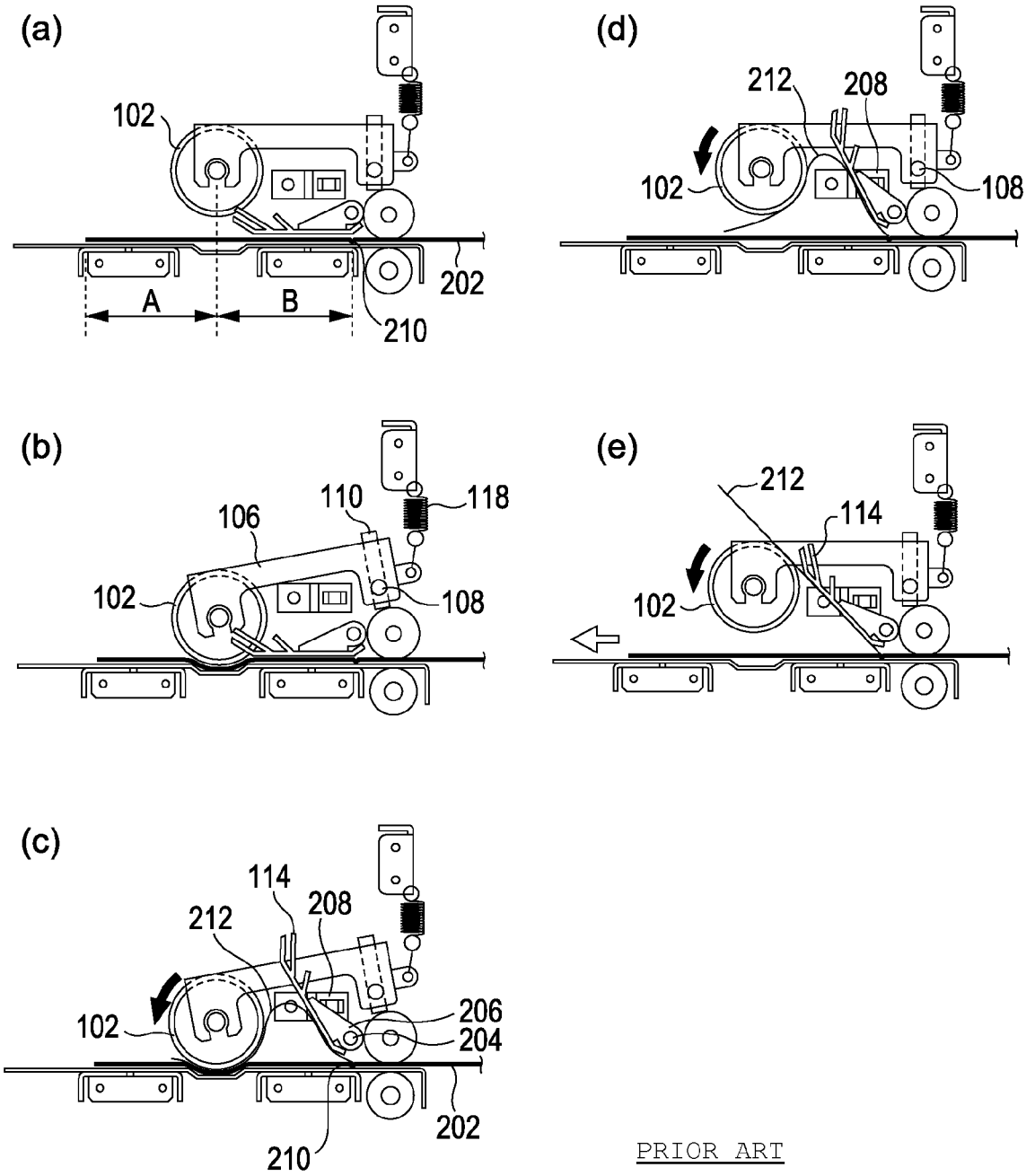
FIG. 2 shows the operation of the conventional page turning apparatus of FIG. 1.

The drawings are merely schematic representations, not intended to portray specific parameters of the invention. The drawings are intended to depict only typical embodiments of the invention, and therefore should not be considered as limiting the scope of the invention. In the drawings, like numbering represents like elements.

DETAILED DESCRIPTION OF THE INVENTION

Figure 3:
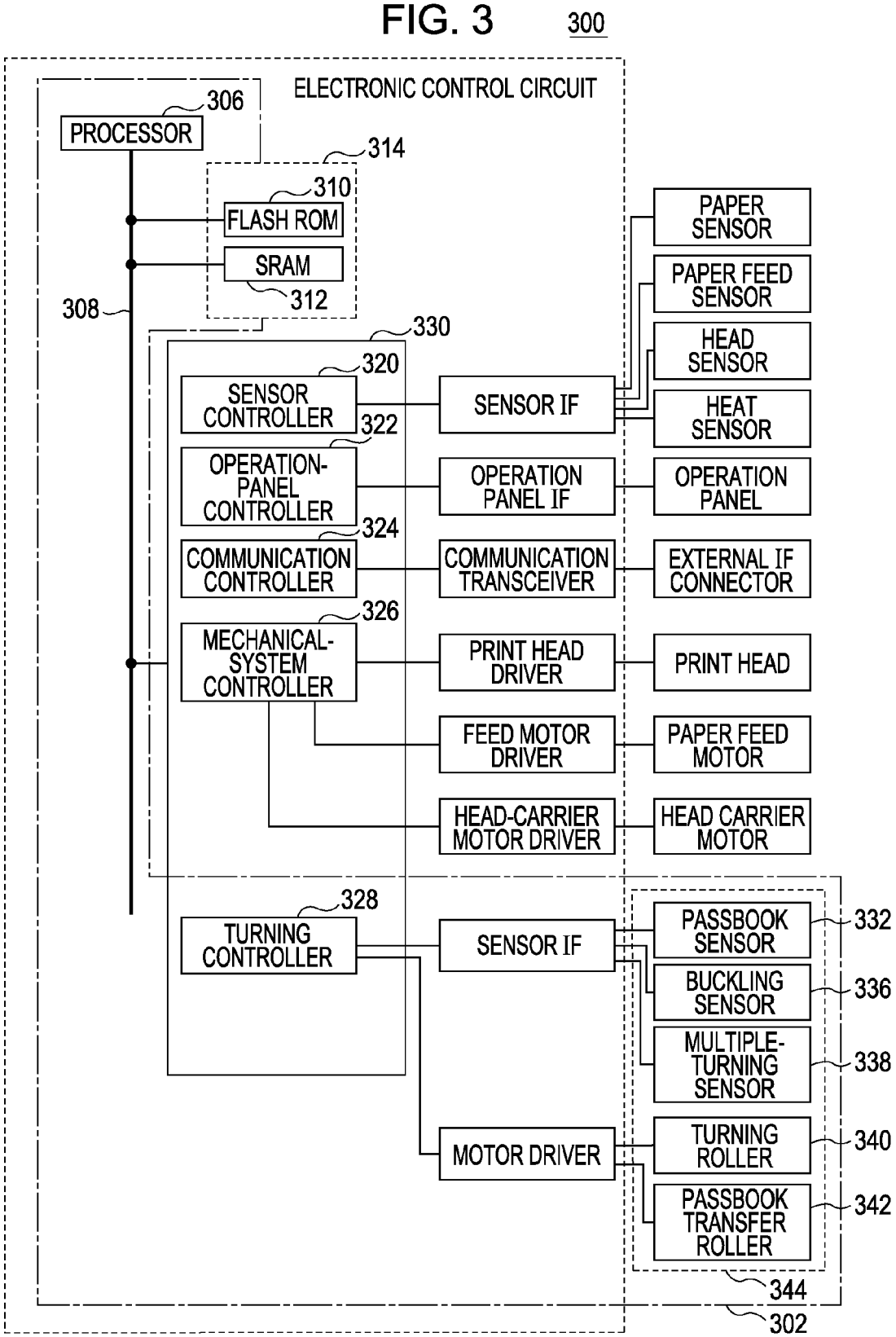
FIG. 3 shows an example of a hardware configuration of a page turning apparatus of a passbook printer according to an embodiment of the present invention and a passbook printer equipped with the page turning apparatus.

FIG. 3 depicts an example of a hardware configuration of a passbook printer page turning apparatus 302 according to an embodiment of the invention and a passbook printer 300 equipped with the page turning apparatus 302.

In this configuration, a memory 314 including a flash ROM 310 and a static random access memory (SRAM) 312 is connected to a common bus 308 that is connected to a processor 306 (also referred to a central processing unit (CPU) or a microprocessing unit (MPU)) that controls the entire operation of the passbook printer 300. A control program for achieving the invention can be stored in the memory 314. The control program can be either a combination of a real-time operating system (OS) for embedded systems such as Windows CE® and application software which operates under the real-time OS or program code for a single embedded system having no hierarchical structure.

The memory 314 may have the function of storing a reference table for various settings used by the invention. That is, a given area of the memory 314 can be used as storing means such as a reference table or the like, to be described later.

The common bus 308 also connects to various logic devices such as a sensor controller 320, an operation panel controller 322, a communication controller 324, a mechanical-system controller 326, and a turning controller 328 for controlling the turning of pages according to the invention. The controllers are equipped in one custom LSI 330, while they may be equipped in different LSIs, divided into some LSIs, and/or equipped in different discrete circuits.

The turning controller 328 connects to a turning mechanism 344 composed of various mechanisms for executing the page turning of the invention, such as a sensor system including a passbook sensor (passbook detector) 332, a buckling sensor (buckling detector) 336, and a multiple turning sensor (multiple-turning detector) 338 and a driving system including a turning roller (turning mechanism) 340 and a passbook transfer roller (conveying mechanism) 342. The turning controller 328 transmits and receives signals to/from the mechanisms to control the function of the mechanisms. The turning controller 328 can function correctly according to a printer control program (or part of the control program) stored in the memory 314.

Thus, the page turning apparatus 302 of a passbook printer according to the invention comprises the turning mechanism 344, the turning controller 328, the control program (or part of the control program) stored in the memory 314, and storing means stored in the memory 314, such as a reference table. A method for turning pages of a passbook printer, according to the invention, is achieved by the page turning apparatus 302. The control program for the page turning apparatus 302 to achieve the turning method is stored in the memory 314.

Figure 4:
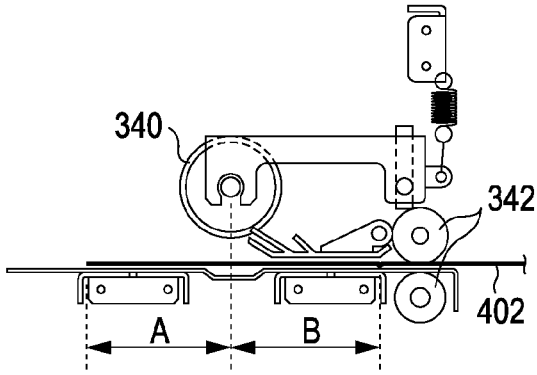
FIG. 4 shows the mechanism of turning the pages of a passbook according to a first embodiment of the invention.
Figure 4:
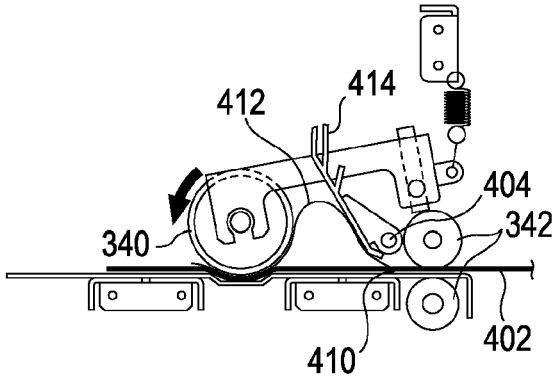
Figure 4:
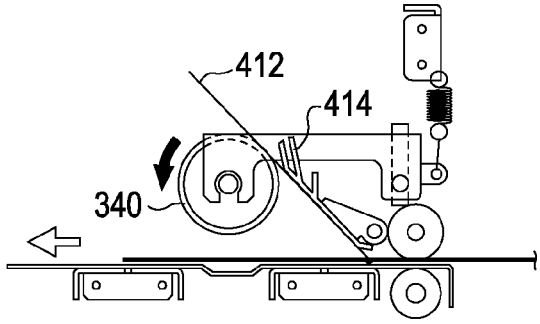
Figure 4:
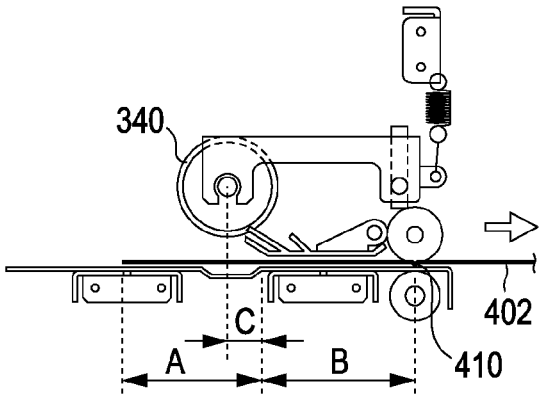
Figure 5:
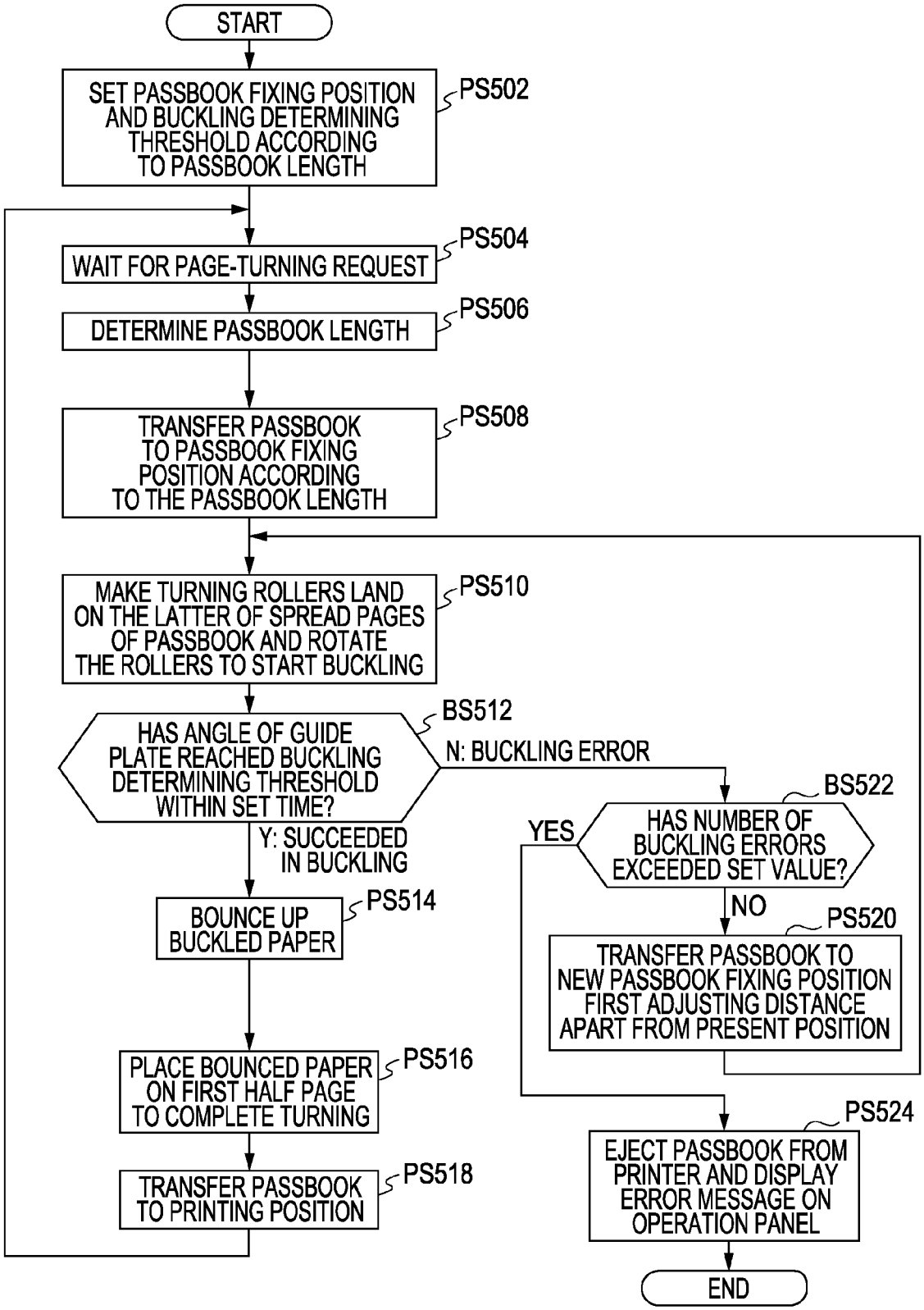
FIG. 5 is a flowchart for the turning operation of the first embodiment.

Referring to FIGS. 4 and 5, a first embodiment of the present invention with the above structure will be described.

FIG. 4 shows the mechanism of turning the pages of a passbook according to the first embodiment as viewed from the side; and FIG. 5 is a flowchart for the turning operation of the first embodiment.

Before the start of a series of page turning processes, the optimum position to fix a passbook 402 (hereinafter, referred to as a "passbook holding position") corresponding to the passbook length is set (stored) in a storing means in advance (PS502). The "passbook length" denotes the distance from the upside of the latter of spread pages (or the passbook folding axis 410) to the opposing lower side. The passbook holding position corresponding to the passbook length can generally be set so that almost the center of the latter page is located directly under the turning rollers 340, although it can be set at a different position.

The passbook holding position can be set in such a manner that optimum passbook holding positions for different passbook lengths determined by experiment or the like are stored as a reference table in the memory 314 or a calculation rule to determine a passbook holding position from a passbook length (e.g., "about the center of the latter of spread pages") can be incorporated in a control program. In PS502, a buckling determining threshold value corresponding to the passbook length is also set.

Suppose that the passbook 402 is in the passbook printer and spread pages are being printed. The spread pages include two pages of the first half and the latter half. When the printing of the latter half is completed and the next page needs to be printed, the passbook printer issues a request to turn the page to the page turning apparatus of the printer. Thus, the passbook page turning process by the page turning apparatus is started in response to the reception of a turning request from the part of the passbook printer other than the page turning apparatus (PS504).

At that time, the passbook 402 is conveyed to the page turning apparatus, with the pages that have just now been printed spread. A passbook sensor 332 is placed in the passbook conveying path so as to determine the length of a conveyed passbook. The length of the inserted passbook 402 is determined by the passbook sensor 332 (PS506). Various known types of passbook sensors can be used as the passbook sensor 332. One example is an optical medium sensor (a combination of an LED and a phototransistor), which is placed on the passbook conveying path to calculate the passbook length from the number of pulses of a passbook conveying stepping motor from the time the upper end of the passbook is detected until the time the lower end is detected.

Upon detection of the passbook length, the passbook conveying roller 342 conveys the passbook 402 to the passbook holding position that is set corresponding to the passbook length in PS502 (see FIG. 4(*a*), PS508). In other words, the passbook 402 is conveyed to the passbook holding position (the position at which A=B holds in FIG. 4(*a*)) at which almost the center of the latter of the spread pages is located directly under the turning rollers 340.

After the passbook is fixed to the passbook holding position, the turning rollers 340 placed in the vicinity of the passbook holding position are pushed against the paper 412 of the latter half of the passbook 402 to be turned, and rotated counterclockwise in FIG. 4 so that the buckling of the paper 412 is started by the friction of the roller surface of the paper 412 (see FIG. 4(*b*), PS510).

Figure 6:
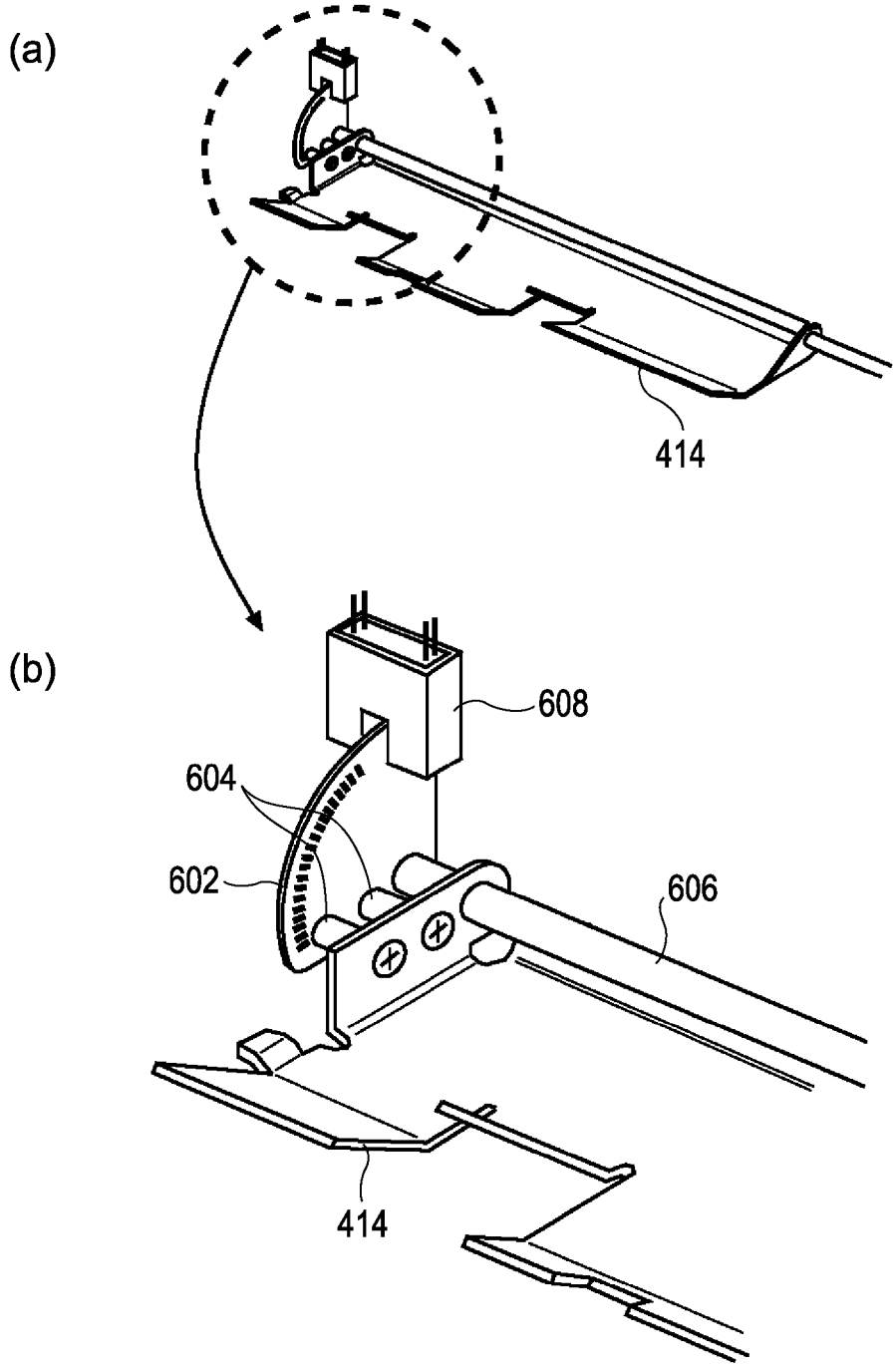
FIG. 6 shows an example of a buckling sensor that can measure the angle of the guide plate raised by buckling.

Upon starting of the buckling of the paper 412, a guide plate 414 is raised with a shaft 404 as a pivot (fulcrum) by the swell of the paper 412. The tilt angle of the raised guide plate 414 is measured by the buckling sensor 336 placed in the vicinity of the turning roller 340. It is determined whether the measured angle exceeds the buckling determining threshold value that is set corresponding to the passbook length in PS502 within a predetermined time from the start of the buckling (BS512). FIG. 6 shows an example of the buckling sensor 336 that can measure the angle of the guide plate 414 raised by buckling. An encoder plate 602 is fixed to the guide plate 414 with spacers 604 therebetween, and can be rotated about a shaft 606, thus monitoring the tilt angle of the guide plate 414 by the count of the encoder pulses sensed by a photo-interrupter sensor 608.

Table 1 is a reference table that shows illustrative buckling determining threshold values corresponding to passbook lengths, for the buckling sensor 336. The reference table can be stored in the memory 314. The reference table illustrates the relationship between passbook lengths, corresponding optimum tilt angles of the guide plate 414, and the counts of corresponding encoder pulses. Specifically, when the count of the encoder pulses read by the buckling sensor 336 exceeds the buckling determining threshold value on the reference table, that is, the count of the encoder pulses corresponding to the determined passbook length in a predetermined time, it is determined that the buckling has succeeded; conversely, when the count has not exceeded the threshold value in a predetermined time, it is determined that a buckling error has occurred.

TABLE 1

| Passbook Length | Optimum Tilt Angle of Guide Plate | Count of Corresponding Encoder Pulses |
|---|---|---|
| 60 mm or more and below 69 mm | 30° | 5 |
| 69 mm or more and below 72 mm | 32° | 6 |
| . | . | . |
| . | . | . |
| . | . | . |
| 111 mm or more and below 114 mm | 62° | 21 |

When it is determined in BS512 that buckling has succeeded, the turning rollers 340 moves slightly upward apart from the spread surface of the passbook 402 in response to that, and rotate counterclockwise in FIG. 4 at high speed for a predetermined time to bounce the angled paper 412 that has landed on the surface of the turning rollers 340 above the turning rollers 340 (see FIG. 4(*c*), PS514).

The paper 412, when bounced, becomes substantially flat between the turning rollers 340 and the guide plate 414. Thereafter, the passbook 402 is conveyed to the left in FIG. 4, so that the bounced paper 412 is turned so as to be placed on the first half of the spread pages (the first half of the pages to be turned), and the turning operation is completed (PS516). The guide plate 414 returns to the initial horizontal position by gravity.

Thus, the turning operation has successfully been completed and as such the passbook 402 is conveyed to the position to print the turned new page (PS518).

On the other hand, when it is determined in BS512 that buckling has failed, that is, the count of the encoder pulses has not exceeded the buckling determining threshold value within a predetermined time, the buckling error must have occurred because the turning rollers 340 have landed too close to the passbook folding axis 410. Therefore, the turning rollers 340 need to be moved a little apart from the folding axis 410 and then execute buckling again. In this case, the passbook 402 is conveyed so that the folding axis 410 becomes a first adjusting distance C apart from the present roller landing position (see FIG. 4(*c*), PS520).

The buckling of the paper 412 is started again with the conveyed position as a new passbook holding position (PS510).

When it is determined in BS512 that the buckling has failed, and the count of the failures has exceeded a predetermined maximum number, then it is determined that the buckling error cannot be corrected by the adjustment of the passbook holding position in PS518 because of some other factors, and the adjustment of the passbook holding position is abandoned. Thus, the process step of ejecting the passbook from the printer and displaying an error message on an operation panel may be added (BS522 and PS524).

Figure 7:
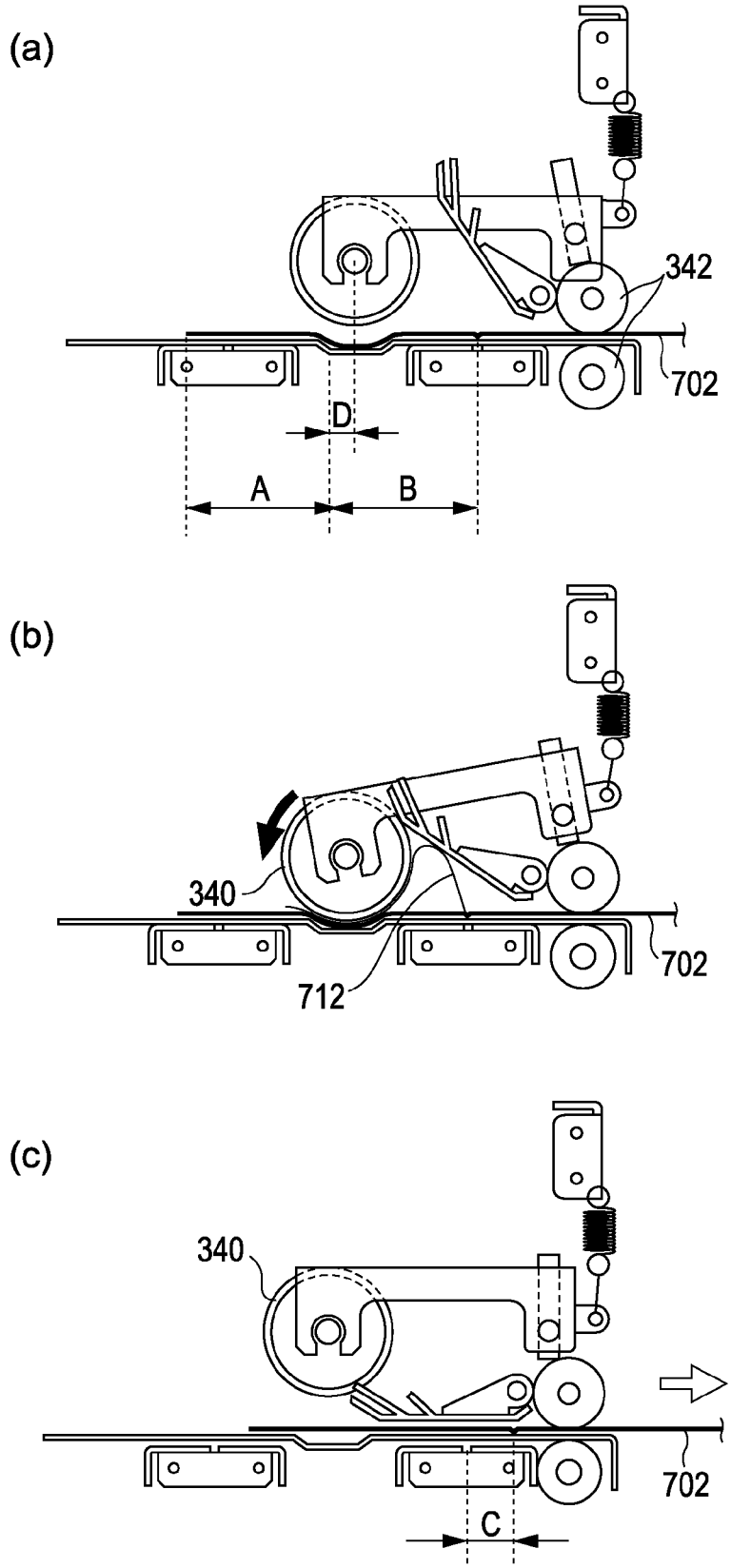
FIG. 7 shows the mechanism of turning the pages of a passbook according to a second embodiment of the invention.
Figure 8:
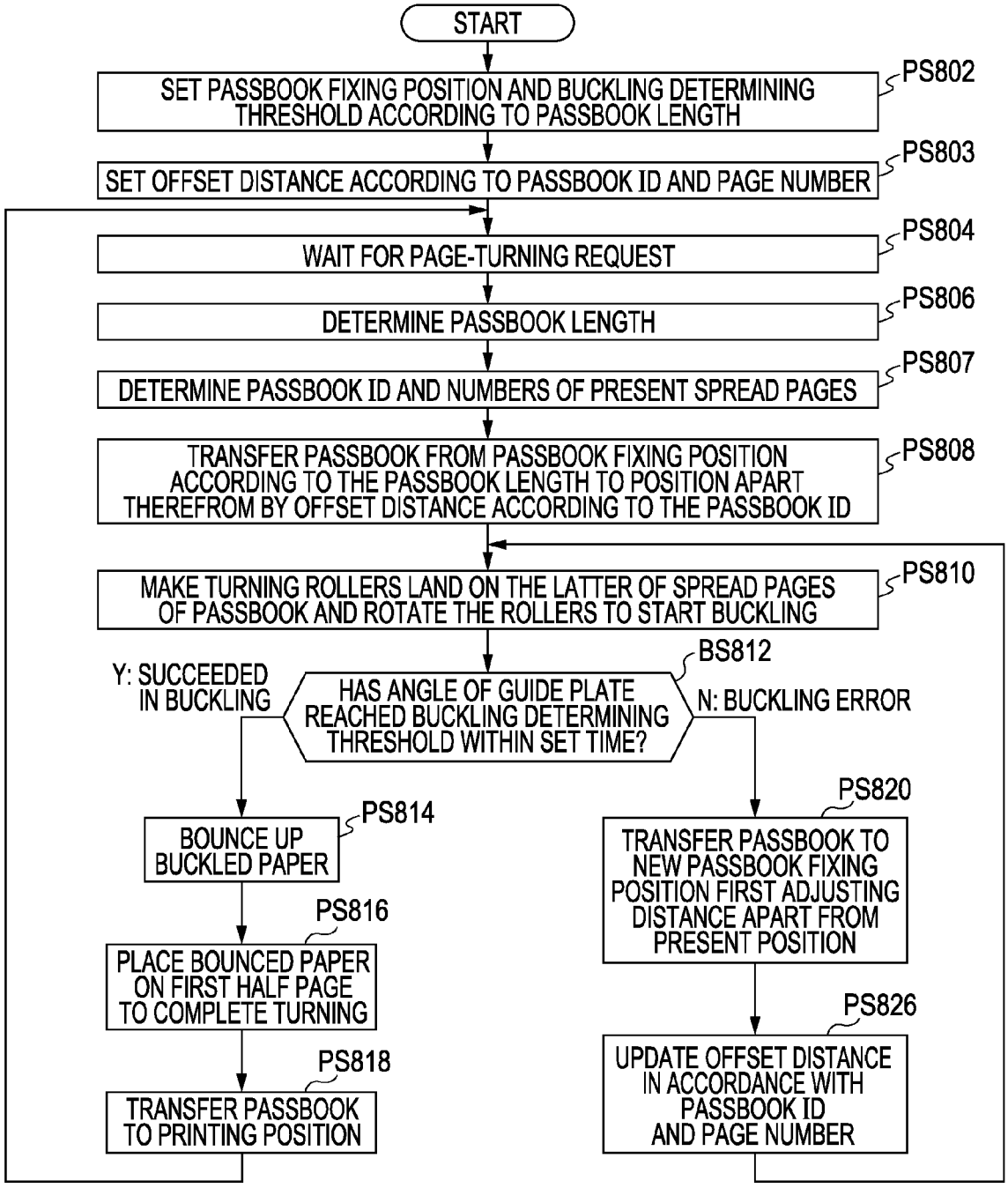
FIG. 8 is a flowchart of the turning operation of the second embodiment.

Referring to FIGS. 7 and 8, a second embodiment of the present invention will be described. FIG. 7 shows the mechanism of turning the pages of a passbook according to the second embodiment as viewed from the side; and FIG. 8 shows the flow of the turning operation of the second embodiment.

As in the first embodiment, a passbook holding position and a buckling determining threshold value corresponding to the passbook length are set in advance before the start of a series of page turning processes (PS802). Furthermore, an offset distance D of the passbook holding position corresponding to the passbook ID and the page number of the passbook is set in advance (PS803). The offset distance refers to an offset value not for conveying the passbook to a passbook holding position corresponding to the passbook length with reference to the passbook holding position, but for conveying the passbook to a position offset therefrom (corrected). The offset includes an offset in the direction in which the folding axis moves away from the turning-roller landing position and an offset in the direction in which the folding axis comes close to the landing position. Thus, it is desirable to set the offset distance as a value with a positive or negative sign. For example, an offset distance for offsetting the passbook apart from the landing position is set as a positive value.

A buckling error, or particularly, double turning tends to occur during a turning operation, depending on the type and a specific page of the passbook. Thus, an offset distance suitable for such tendency is preset.

Table 2 illustrates examples of the correlation between the types of passbook (passbook ID) and specific pages of the passbook, the characteristics, tendency during turning, and offset distances set in view of them. The table shows that the passbook of passbook ID 001 tends to cause double turning of all the pages because of larger friction between papers than normal ones, and thus an offset distance of −10 mm is set so that the turning rollers are landed to a position 10 mm closer to the folding axis than normal ones. For the passbook of passbook ID 002, the hardness of all the pages is lower (softer) than normal ones, so that it easily buckles, and thus double turning is prone to occur. Therefore, an offset distance of −7 mm is set.

For the passbook of passbook ID 003, the binding is not so tight that the central pages tend to open (there is a clearance between central pages even if closed). Thus, turning of two pages before the central spread pages (that is, four pages before the latter of the central pages) tends to be double turning to spread the central pages. Thus, the offset distance is set to −12 mm.

For the passbook of passbook ID 004, all the pages have lower friction than normal ones, causing little buckling. Thus, the offset distance is set to +10 mm so that the turning rollers land to a position 10 mm more apart from the folding axis than normal ones.

TABLE 2

| Passbook ID | Passbook Page | Characteristics of Passbook/Paper | Tendency during Turning | Offset Distance |
|---|---|---|---|---|
| 001 | All pages | High friction between papers | Tendency to cause double turning | −10 mm |
| 002 | All pages | Low hardness of paper | Tendency to cause double turning | −7 mm |
| 003 | Four pages before the latter of central pages | Binding Is Not so Tight that central pages tend to open | Tendency to cause double turning | −12 mm |
| 004 | All pages | Low friction between papers | Tendency to cause buckling error | +10 mm |
| . | . | . | . | . |
| . | . | . | . | . |
| . | . | . | . | . |

Upon reception of a turning request from the part of the passbook printer other than the page turning apparatus, the page turning apparatus starts turning of pages in response to that (PS804).

First, the passbook sensor determines the length of a passbook 702 (PS806), and then determines the passbook ID and the numbers of the present spread pages (PS807).

Then, the passbook conveying roller 342 conveys the passbook 702 to the position offset from the passbook holding position by the offset distance D with reference to the passbook holding position preset in PS802 corresponding to the determined passbook length and the offset distance D preset in PS803 corresponding to the determined passbook ID (see FIG. 7(*a*), PS808).

After the passbook 702 is fixed to the conveyed position, the turning rollers 340 are pushed against the paper 712 of the latter of the spread pages, and are rotated counterclockwise in FIG. 7 to start the buckling of the paper 712 by the friction between the turning rollers 340 and the paper 712 (see FIG. 7(*b*), PS810).

It is determined by the buckling sensor 336 whether the buckling of the paper 712 has succeeded (BS812), wherein when it is determined that the buckling has succeeded, the paper 712 is bounced above the turning rollers 340 (PS814), and is then placed onto the first half of the spread pages. The turning operation is thus completed (PS816). Upon completion of the turning, the passbook 702 is conveyed to the position to print the new page (PS818). This is the same as the first embodiment.

When it is determined that the buckling of the paper 712 has failed, the passbook 702 is conveyed from the present turning rollers 340 landing position to the position apart from the passbook folding axis by a first adjustment distance C (see FIG. 7(*c*), PS820). Then the buckling of the turning target page is started again, with the conveyed position as a new passbook holding position (PS810).

The failure of the buckling may be caused by the incorrect offset distance that is preset in PS803 and used in PS808. Therefore, it is desirable to update the offset distance set in PS803 so that when the same type of passbook is inserted into the page turning apparatus, the new passbook is offset directly to the new passbook holding position. The updating step may be provided around the step PS820 (PS826).

Figure 9:
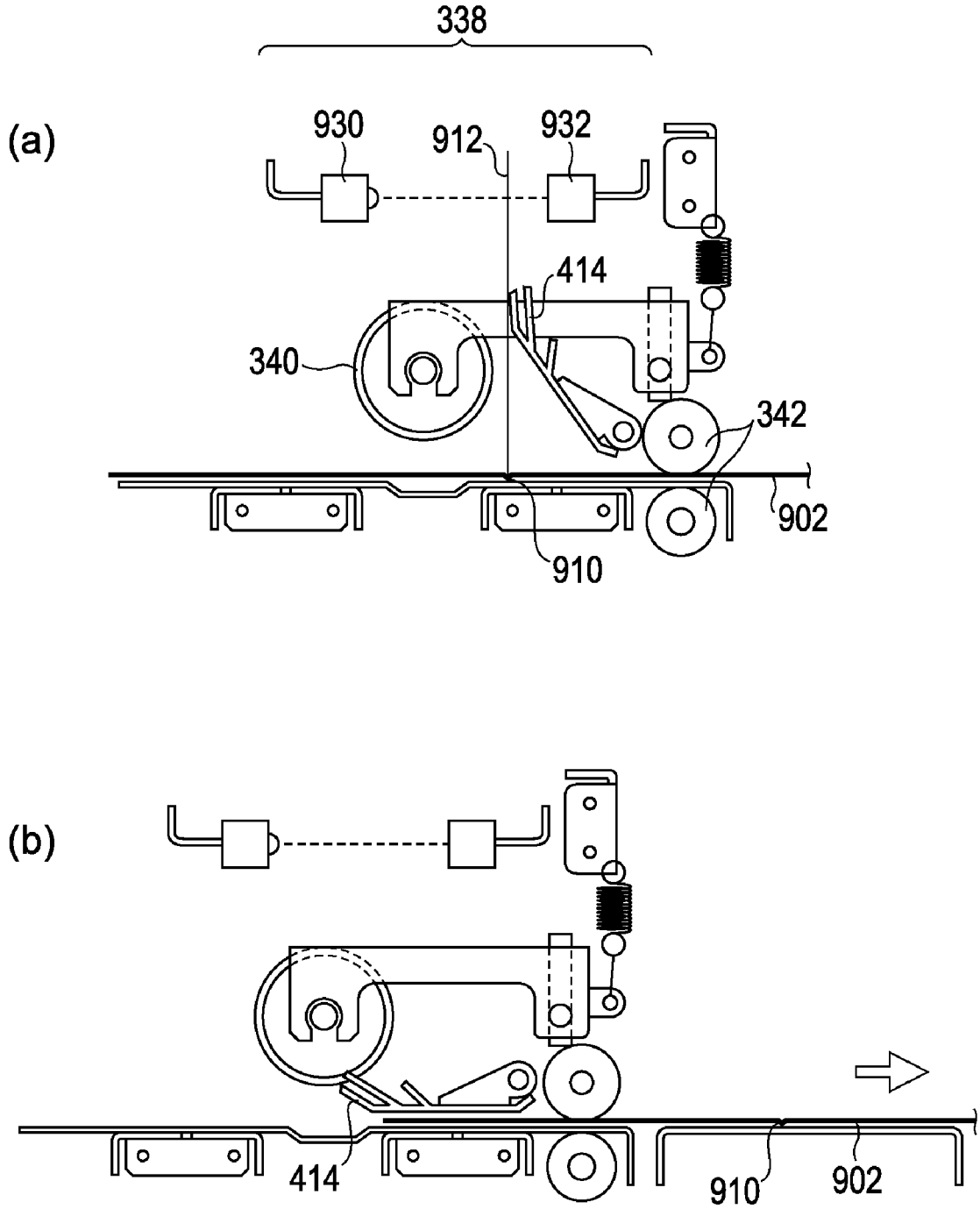
FIG. 9 shows the mechanism of turning the pages of a passbook according to a third embodiment of the invention.
Figure 10:
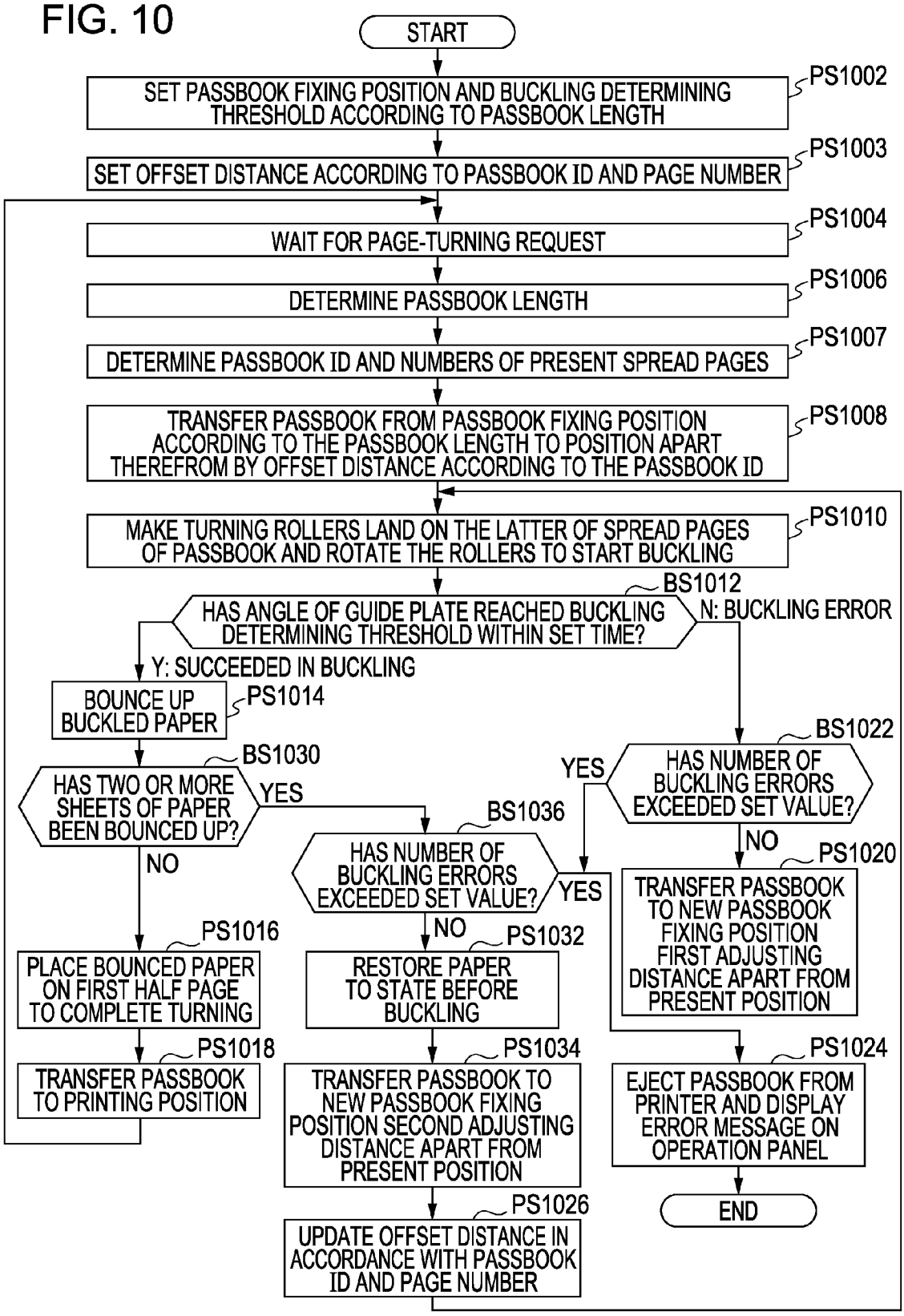
FIG. 10 is a flowchart of the turning operation of the third embodiment.

Referring to FIGS. 9 and 10, a third embodiment of the present invention will be described. FIG. 9 shows the system of turning the pages of a passbook according to the third embodiment as viewed from the side; and FIG. 10 shows the flow of the turning operation of the third embodiment.

A passbook holding position and so on corresponding to the passbook length are set in advance before the start of a series of page turning processes (PS1002 and PS1003). A turning operation is started in response to a turning request (PS1004). A passbook sensor determines the length of the passbook and so on (PS1006 and PS1007). Then, the passbook 902 is conveyed to the position offset from the passbook holding position by the offset distance (PS1008), at which buckling is started by the rotation of the turning rollers 340 (PS1010), and it is determined whether the buckling has succeeded (BS1012). Those steps are the same as those of the second embodiment.

The processes in case of failure of the buckling (PS1020 and PS1026, BS1022, and PS1024) are also the same as those of the second embodiment.

When it is determined in BS1012 that the buckling has succeeded, the turning rollers 340 are moved slightly upward apart from the spread pages of the passbook 902 in response to that, and are rotated counterclockwise in FIG. 9 at high speed for a predetermined time to bounce the angled paper 912 that has landed on the surface of the turning rollers 340 above the turning roller 340 (PS1014). When the passbook 902 whose paper 912 is bounced is conveyed to the left in FIG. 9, the paper 912 becomes substantially perpendicular to the spread surface (see FIG. 9(*a*)). This timing, that is, the timing at which the folding axis 910 of the passbook 902 comes almost directly under the right outer circumference of the turning rollers 340 can easily be determined by the conveying roller 342 which controls the conveyance.

At normal buckling, only one object paper is bounced perpendicularly; however, when two or more papers have been buckled, the two or more papers are sometimes bounced. Therefore, the apparatus has a multiplex sensor 338 including an LED 930 of a transmissive sensor (or a sound transmitter of an ultrasound sensor) on one side of the bounced paper and a phototransistor 932 of a transmissive sensor (or a sound receiver of an ultrasound sensor) on the other side, with which it is determined whether two or more papers have been bounced after the success of buckling (BS1030).

When it is determined in BS1030 that two or more papers have been bounced, the passbook 902 is conveyed to the right in FIG. 9. This movement causes the bounced two or more papers to be held by the guide plate 414 into the state before buckling (see FIG. 9(*b*), PS1032).

Such buckling and bouncing of two or more papers may be caused by the excessively long distance of the turning rollers 340 landing position from the passbook folding axis. This requires moving the turning rollers 340 landing position a little closer to the folding axis, and executing buckling again. Thus, in this case, the passbook 902 is conveyed so that the present turning rollers 340 landing position comes close to the passbook folding axis by a second adjusting distance (PS1034).

Then, the buckling of the turning target page is started to execute turning again, with the conveyed position as a new passbook holding position (PS1010).

As for a buckling error, the updating of the offset distance set in PS1003 may be provided around PS1034 (PS1026).

When it is determined in BS1030 that two or more papers have been bounced, and the count of the bouncing has exceeded a predetermined maximum number, then it is determined that the buckling of two or more papers cannot be corrected by the adjustment of the passbook holding position in PS1034 because of some other factors, and the adjustment of the passbook holding position is abandoned. Thus the process step of ejecting the passbook from the printer and displaying an error message on an operation panel may be added (BS1036 and PS1024).

When it is determined in BS1030 that only one paper has been bounced, it indicates that normal buckling and bouncing have been performed. Therefore, the passbook 902 is conveyed to the left in FIG. 9(*a*) so that the bounced paper 912 is placed on the first half of the spread pages, and the turning operation is completed (PS1016). Then the passbook 902 is conveyed to the position to print a new page (PS1018).

The foregoing description of the embodiments of this invention has been presented for purposes of illustration and description. It is not intended to be exhaustive or to limit the invention to the precise form disclosed, and many modifications and variations are possible.

What is claimed is:

1. An apparatus equipped in a passbook printing available printer, for turning pages of a passbook that is unfolded on both sides of a folding axis, comprising:

a conveying path through which the passbook is conveyed;

a detecting device placed in a position of the conveying path, for detecting a size of the pages of the passbook;

storing means for storing a passbook holding position on the conveying path corresponding to the size, and a threshold value corresponding to the size;

a page turning mechanism placed in a vicinity of the passbook holding position and configured to buckle a paper of a turning target page of the passbook conveyed to the passbook holding position and to turn the buckled paper about a folding axis until the paper is overlapped on a previous page of the turning target page;

a buckling sensor placed in a vicinity of the page turning mechanism, for sensing a buckling status for the paper;

a conveying mechanism for conveying with a driving control the passbook to a designated position on the conveying path; and control means configured to recognize the passbook holding position corresponding to the size and the threshold value corresponding to the size by referencing the storing means, drive the conveying mechanism so that the passbook is conveyed to the passbook holding position, and drive the page turning mechanism so that it starts buckling of the paper, wherein the control means, if the buckling status sensed by the buckling sensor indicates that an extent of the buckling does not reach over the threshold value within a predetermined time, determines that the buckling has failed and drives the conveying mechanism so that the passbook is conveyed from the passbook holding position to a first revised position apart from the passbook holding position by a first adjusting distance.

2. The apparatus according to claim 1, wherein the detecting device further detects an identification of the passbook;

the storing means further stores an offset distance corresponding to the identification;

the control means further recognizes the offset distance corresponding to the determined identification by referencing the storing means;

wherein driving the conveying mechanism so that the passbook is conveyed to the passbook holding position includes driving the conveying mechanism so that the passbook moves to an offset holding position apart from the passbook holding position by the offset distance.

3. The apparatus according to claim 2, wherein if the control means determines that the buckling has failed, the control means updates the offset distance stored corresponding to the identification, so that the offset holding position determined according to the updated offset distance matches the first revised position.

4. The apparatus according to claim 3, further comprising:

a multiple sheet sensor placed so as to sense the paper turned about the folding axis and configured to detect whether multiple papers including the paper are being turned, wherein if the multiple sheet sensor detects that multiple papers are turned, the control means drives the conveying mechanism so that the multiple papers return to a position before the buckling and that the passbook moves to a second revised position apart from the passbook holding position by a second adjusting distance.

5. The apparatus according to claim 4, wherein the page turning mechanism includes a roller whose rotation shaft is in parallel to the folding axis of the passbook in the passbook holding position, wherein the roller can be moved between a first position apart from the passbook in the passbook holding position and a second position in contact with the paper of the turning target page of the passbook, and wherein the roller is rotated so that a portion of the paper in contact with the roller is displaced toward the folding axis, thereby buckling the paper.

6. The apparatus according to claim 5, wherein the size includes a length of the passbook which is parallel to a face of the passbook and perpendicular to the folding axis; and the passbook holding position corresponding to the size includes the position of the passbook in a case where the roller is in contact with a center line between the folding axis and an opposing side of the turning target page.

7. The apparatus according to claim 4, wherein the buckling sensor includes a guide plate movable with the buckling of the paper and a sensor that detects a movement of the guide plate;

the threshold value is determined in association with the movement of the guide plate; and determining that the buckling has failed includes determining that the buckling has failed if the movement has not exceeded the threshold value within a predetermined time starting at a beginning of the buckling.

8. The apparatus according to claim 4, wherein the offset distance corresponding to the identification depends on a thickness and coefficient of sliding friction of the paper of the passbook associated with the identification.

9. The apparatus according to claim 4, wherein the identification includes a page number of the turning target page; and the offset distance corresponding to the identification depends on the page number.

10. The apparatus according to claim 4, wherein the multiple sheet sensor includes a transmissive sensor having a light transmitter placed on one side of the paper that turns about the folding axis and a light receiver placed on an opposing side of the paper.

11. A method for turning pages of a passbook that is unfolded on both sides of a folding axis, by a page turning apparatus equipped in a passbook printing available printer, comprising:

storing a passbook holding position corresponding to a size of the pages of the passbook, and a threshold value corresponding to the size;

detecting the size of the pages of the passbook in response to a page turning request;

conveying, by referencing a value of the passbook holding position corresponding to the size, the passbook to the passbook holding position;

buckling the paper of a turning target page of the passbook conveyed to the passbook holding position;

sensing a buckling status for the paper;

determining that the buckling has failed if the buckling status shows that an extent of the buckling does not reach over the threshold value within a predetermined time;

if it is determined that the buckling has succeeded, turning the buckled paper about a passbook folding axis so that the paper is placed on a previous page of the turning target page; and if it is determined that the buckling has failed, conveying the passbook from the passbook holding position to a first revised position apart from the passbook holding position by a first adjusting distance, and repeating the buckling at the position.

12. The method according to claim 11, further comprising:

storing an offset distance corresponding to an identification of the passbook: and detecting the identification of the passbook in response to the page turning request, wherein conveying the passbook to the passbook holding position includes conveying, by referencing the offset distance, the passbook to an offset holding position apart from the passbook holding position by the offset distance.

13. The method according to claim 12, further comprising:

if it is determined that the buckling has failed, updating the offset distance stored corresponding to the identification, so that an offset holding position determined according to the updated offset distance matches the first revised position.

14. The method according to claim 13, further comprising:

if it is determined that the buckling has succeeded, detecting whether a plurality of papers including the paper are being turned about the folding axis;

if it is determined that the plurality of papers are being turned, conveying the passbook so that the plurality of papers return to a position before the buckling; and conveying the passbook from the passbook holding position to a second revised position apart from the passbook holding position by a second adjusting distance, and repeating the buckling at the second revised position.

15. A control program product including program code embodied on a computer readable medium equipped in a passbook printing available printer, for turning pages of a passbook that is unfolded on both sides of a folding axis, the program code comprising:

program code for storing a passbook holding position corresponding to a size of the pages of the passbook, and a threshold value corresponding to the size;

program code for detecting the size of the pages of the passbook in response to a page turning request;

program code for conveying, by referencing a value of a passbook holding position corresponding to the size, the passbook to the passbook holding position;

program code for buckling the paper of a turning target page of the passbook conveyed to the passbook holding position;

program code for sensing a buckling status for the paper;

program code for determining that the buckling has failed if the buckling status shows that a buckling extent does not reach over the threshold value within a predetermined time;

program code for turning the buckled paper about the passbook folding axis so that the paper is placed on a previous page of the turning target page if it is determined that the buckling has succeeded; and program code for conveying the passbook from the passbook holding position to a first revised position apart from the passbook holding position by a first adjusting distance, and repeating the buckling at the position, if it is determined that the buckling has failed.

16. A passbook printing available printer having a mechanism for turning pages of a passbook that is unfolded on both sides of a folding axis, the printer comprising:

a printing mechanism capable of printing on a surface of the unfolded pages of the passbook;

a conveying path through which the passbook is conveyed from the printing mechanism;

a detecting device placed in a position of the conveying path, for detecting a size of the pages of the passbook;

storing means for storing a passbook holding position on the conveying path corresponding to the size and a threshold value corresponding to the size;

a page turning mechanism placed in a vicinity of the passbook holding position and configured to buckle the paper of a turning target page of the passbook conveyed to the passbook holding position and to turn the buckled paper about the folding axis until the paper is overlapped on a previous page of the turning target page;

a buckling sensor placed in a vicinity of the page turning mechanism, for sensing a buckling status for the paper;

a conveying mechanism for conveying with a driving control the passbook to a designated position on the conveying path; and control means configured to recognize the passbook holding position corresponding to the size and the threshold value corresponding to the size by referencing the storing means, drive the conveying mechanism so that the passbook is conveyed to the passbook holding position, and drive the page turning mechanism so that it starts buckling of the paper, wherein the control means, if the buckling status sensed by the buckling sensor indicates that an extent of the buckling does not reach over the threshold value within a predetermined time, determines that the buckling has failed and drives the conveying mechanism so that the passbook is conveyed from the passbook holding position to a first revised position apart from the passbook holding position by a first adjusting distance.

17. An apparatus equipped in a notebook printing available printer, for turning pages of a notebook that is unfolded on both sides of a folding axis, the apparatus comprising:

a conveying path through which the notebook is conveyed;

a detecting device placed in a position of the conveying path, for detecting a size of the pages of the notebook;

storing means for storing a notebook holding position on the conveying path corresponding to the size, and a threshold value corresponding to the size;

a page turning mechanism placed in a vicinity of the notebook holding position and configured to buckle the paper of a turning target page of the notebook conveyed to the notebook holding position and to turn the buckled paper about the folding axis until the paper is overlapped on a previous page of the turning target page;

a buckling sensor placed in a vicinity of the page turning mechanism, for sensing a buckling status for the paper;

a conveying mechanism for conveying with a driving control the notebook to a designated position on the conveying path; and control means configured to recognize the notebook holding position corresponding to the size and the threshold value corresponding to the size by referencing the storing means, drive the conveying mechanism so that the notebook is conveyed to the notebook holding position, and drive the page turning mechanism so that it starts buckling of the paper, wherein the control means, if the buckling status sensed by the buckling sensor indicates that an extent of the buckling does not reach over the threshold value within a predetermined time, determines that the buckling has failed and drives the conveying mechanism so that the notebook conveyed from the notebook holding position to a first revised position apart from the notebook holding position by a first adjusting distance.

* * * * *